United States Patent [19]

Takahashi et al.

[11] 4,207,732

[45] Jun. 17, 1980

[54] HAND-INDICATION TYPE ELECTRONIC TIMEPIECE

[75] Inventors: Shigekazu Takahashi; Shinji Sawada, Ena, both of Japan

[73] Assignee: Ricoh Watch Co., Ltd., Nagoya, Japan

[21] Appl. No.: 940,382

[22] Filed: Sep. 7, 1978

Related U.S. Application Data

[62] Division of Ser. No. 825,084, Aug. 16, 1977.

[51] Int. Cl.[2] ..... G04C 3/00; G04B 27/00

[52] U.S. Cl. ..... 368/76; 368/185

[58] Field of Search ..... 58/4 A, 7, 19, 23 R, 58/38, 39, 39.5, 50, 57.5, 58, 23 D, 85.5; 335/92 T

[56] References Cited

U.S. PATENT DOCUMENTS 4,143,509 3/1979 Weibel ..... 58/85.5 X

*Primary Examiner*—Edith S. Jackmon

*Attorney, Agent, or Firm*—Koda and Androlia

[57] ABSTRACT

A hand-indication type electronic timepiece is disclosed which has a vibrator such as a quartz crystal vibrator, an electronic circuit including an oscillator, a frequency divider, a driver, and a motor for operating hands, and other components, said electronic circuit comprising a plurality of pulse control circuits for different functions such as a pulse generator for normal hand operation, a fast feed pulse forming circuit, a pulse output stop circuit, and a circuit for producing output pulses for said normal hand operation after some specific periods of time with external control signals applied thereto as input signals, said pulse control circuits being selectively operated by external operating means, so that said motor for operating hands may be controlled by multiple steps by said external operating means.

1 Claim, 10 Drawing Figures

HAND-INDICATION TYPE ELECTRONIC TIMEPIECE

This is a division of application Ser. No. 825,084, filed Aug. 16, 1977.

BACKGROUND OF THE INVENTION

1. Field of the Invention

This invention relates to a hand-indication type electronic timepiece which having a vibrator such as a quartz crystal vibrator, an electronic circuit including a oscillator, a frequency divider, a driver, and a motor for operating hands, and other components.

2. Description of the Prior Art

All conventional electronic watches or clocks are provided with winding crowns for setting hands by mechanical means.

Such mechanical means or mechanism for setting hands occupies a large space in a small timepiece, and requires a number of processes in a total production line. This has been a great difficulty in reduction of watch size and cost. In addition, loading by a wheel train for setting hands means loading on hand driving, which often causes trouble with timepieces.

SUMMARY OF THE INVENTION

It is an object of the invention to provide a hand-indication type electronic timepiece whose size and thickness can be reduced.

It is another object of the invention to provide a hand-indication type electronic timepiece whose cost can be reduced by decreasing the number of production processes and making the manufacture easy.

It is still another object of the invention to provide a hand-indication type electronic timepiece whose pulse motor has high conversion efficiency by increasing parts for electromagnetic action and decreasing leakage flux.

It is still another object of the invention to provide a hand-indication type electronic timepiece whose pulse motor has a rotor member made of anisotropic magnetic material, which is low in cost and strong in magnetism.

It is a further object of the invention to provide a hand-indication type electronic timepiece whose pulse motor can produce high torque even small in size.

It is a still further object of the invention to provide a hand-indication type electronic timepiece whose pulse motor assures accurate operation and high stability.

It is a still further object of the invention to provide a hand-indication type electronic timepiece whose pulse motor eliminates its adjustment by using spacers easy to work for simple assembly and disassembly.

It is a still further object of the invention to provide a hand-indication type electronic timepiece whose pulse motor is easy to design.

DETAILED DESCRIPTION OF THE PREFERRED EMBODIMENTS

First, here will be generally explained a hand-indication type electronic timepiece of the invention.

Figure 1:
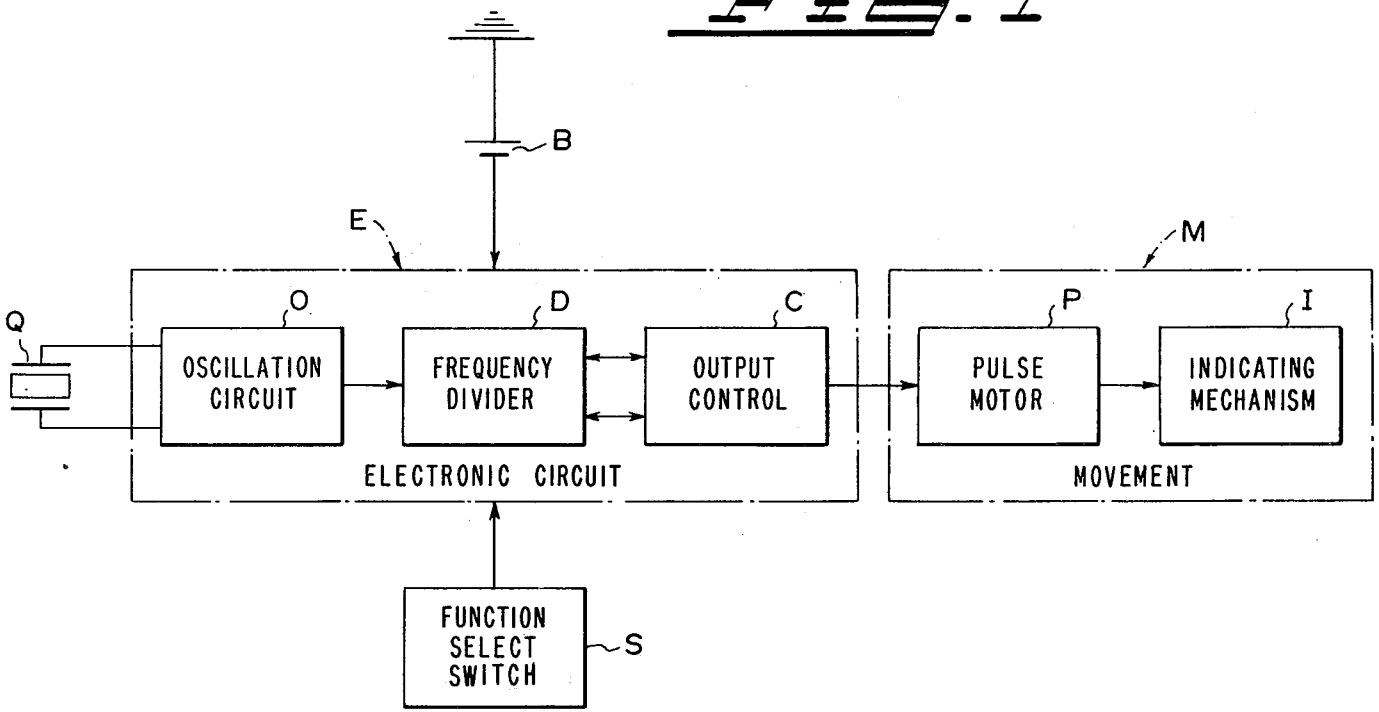
FIG. 1 is a block diagram of a hand-indication type electronic timepiece of the invention, showing the outline.

As will be clear from the block diagram of FIG. 1, the timepiece of this invention comprises a quartz crystal vibrator Q, an electronic circuit E which includes oscillation circuit O, frequency divider D, and output control C, connected to the vibrator Q, movement M having a pulse motor P and an indicating mechanism I, connected to the electronic circuit E, a battery B for supplying power to the circuit E, and a function select switch S for controlling the circuit E.

Figure 2:
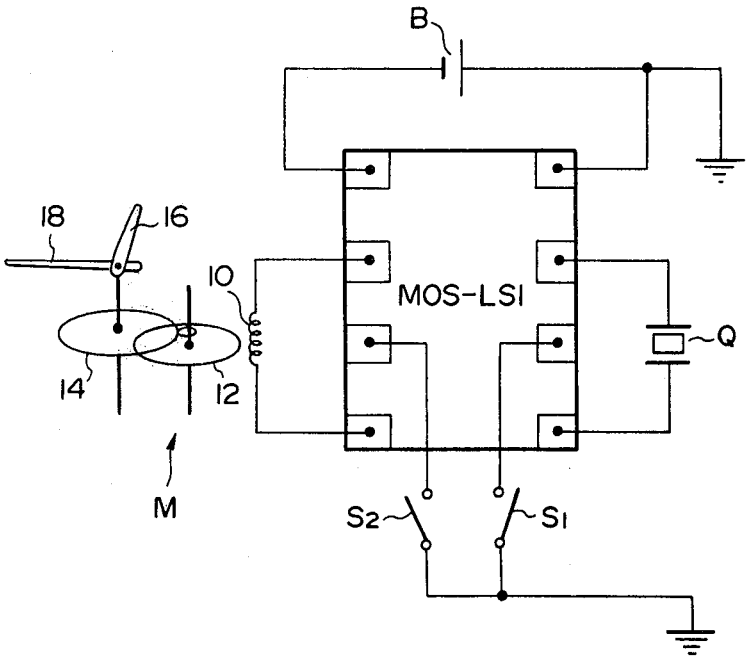
FIG. 2 is a connection diagram of the timepiece of FIG. 1.

As readily understood from the connection diagram of FIG. 2, the timepiece of the invention has two function select switches, the one is a quick switch $S_1$ and the other is a reset switch $S_2$. These two switches control separate circuits formed in a MOS-LSI device respectively. In other words, the MOS-LSI device is connected to the two switches $S_1$ and $S_2$, the quartz crysal vibrator Q, a driving coil 10 for running the pulse motor P, and the battery B at their respective terminals. In the device are formed the oscillation circuit O, the frequency divider D, and the output control C. A reference numeral 12 represents a rotor in the pulse motor; 14 a minute wheel driven by the rotor 12 in the foregoing indicating mechanism I; and 16 and 18 hour and minute hands respectively which are driven by means of the minute wheel 14.

Figure 3:
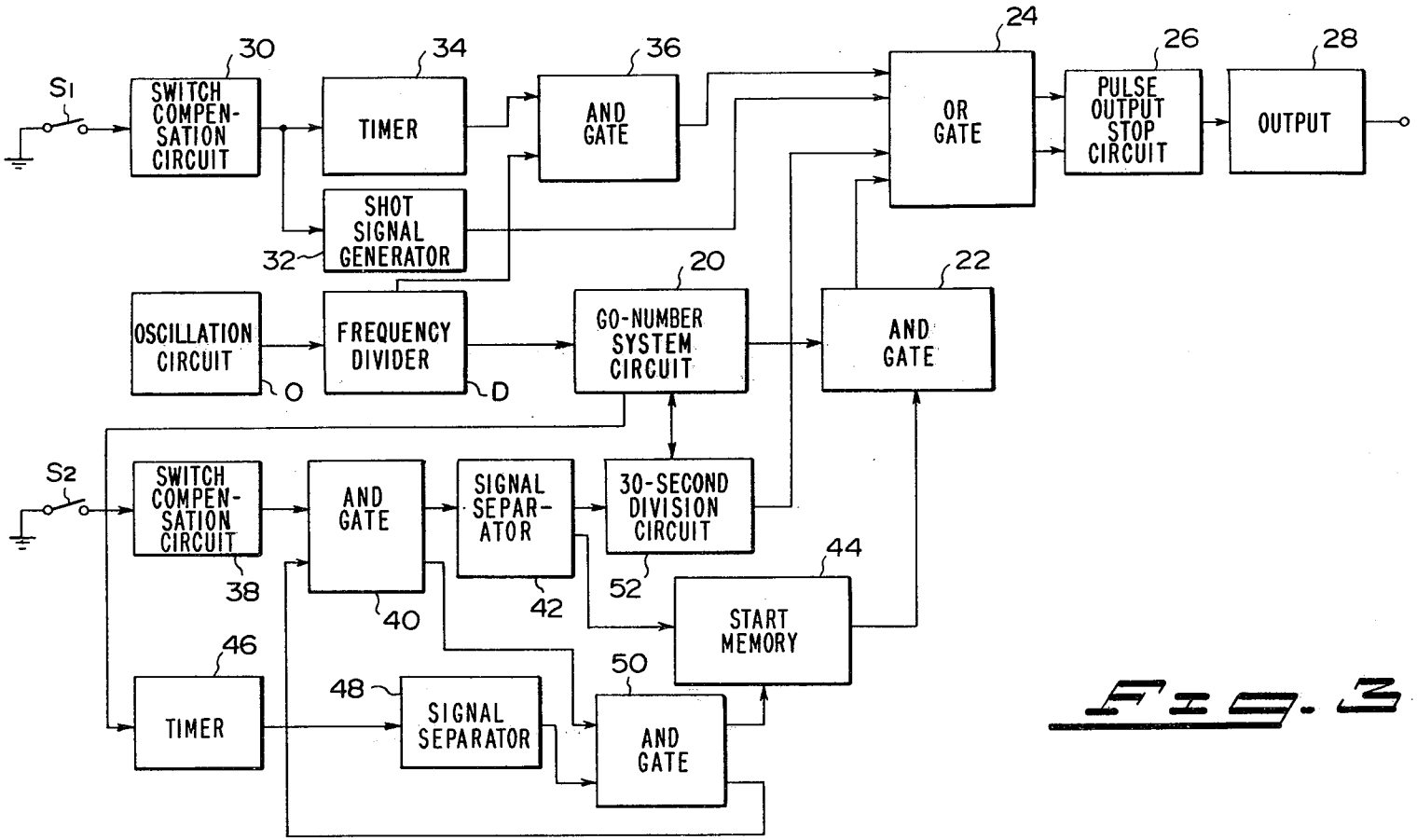
FIG. 3 is a block diagram of an electronic circuit in a practical form.

Referring now to FIG. 3, the electronic circuit E for the timepiece of the invention will be explained in detail.

When the quick switch $S_1$ and the reset switch $S_2$ are not ON or in their conductive state, output pulses from a 60-number system counter 20 for counting one-Hz pulse delivered from the frequency divider D are fed finally from the output 28 as normal hand-operating pulses through AND gate 22, OR gate 24, and pulse output stop circuit 26, said output pulses having a period of one minute. Thus, both hands are operated stepwise by every one minute.

When the quick switch $S_1$ is turned ON and OFF in a short time through any external operating means such as a button (not shown), a switch compensation circuit 30 produces specific electric signals at the time of ON operation. Such signals activate a shot signal generator 32, and shot signals are fed from the output 28 through the OR gate 24 and the pulse output stop circuit 26. Such shot signals may move both hands stepwise at each time of ON-OFF operation of the quick switch $S_1$.

If the quick switch $S_1$ is kept ON, fast feed pulses (such as 8-Hz pulses) are fed from the frequency divider D as output pulses likewise though the AND gate 36 after a preset time (two to three seconds) by means of a timer 34 so that both hands may be moved fast.

When the quick switch $S_1$ is turned OFF after its ON state kept for some time, the pulse output stop circuit 26 operates to stop the pulse output and consequently the pulse motor is turned inoperative.

When the reset switch $S_2$ is put ON in the inoperative state of the pulse motor by any external operating means (not shown), a switch compensation circuit 38 produces a specific signal, which is fed to a signal separator 42 through an AND gate 40, and a signal from the signal separator is stored in a start memory 44. On the other hand, a pulse from the 60-number system counter 20 drives a timer 46, and a timer output is applied to the start memory 44 through a signal separator 48 and an AND gate 50. Thus, the signal stored in the start memory 44 is read out, and the signal is applied to the pulse output stop circuit 26 for turning the circuit from a cut-off state to a conductive state. As a result, a pulse from the 60-number system counter 20 is fed as a normal output signal from the output 28, and the pulse motor is turned into its normal operative state after a period of one minute.

If the reset switch $S_2$ is put ON twice in the pulse cut-off state in a given time, for example, in ten seconds, which is set by the timer 46, two signals from the signal separator 42 is stored in the start memory 44. Thus, two output pulses are produced from the 60-number system counter 20, and the signal read out in the start memory 44 is produced after reception of such two pulses. Consequently the pulse output stop circuit 26 is turned conductive after a period to two minutes.

In this manner, normal hand operation can be started after one minute by ON-OFF operation of the reset switch $S_2$ one time in a given time (in 10 seconds), or after two minutes by ON-OFF operation two times or after three minutes by ON-OFF operation three times in the same given time. For ON-OFF operation four or more times, the start memory 44 is so arranged as to repeat such periods of delay time as described supra, which are determined by ON-OFF operation one to three times in the given time.

With such arrangement, troublesome time setting is eliminated, which must be otherwise done by turning hands fast by 12 hours or waiting for some minutes, by starting normal hand operation, for example, two or three minutes later, in case the timepiece is fast by several minutes, just by ON-OFF operation of the reset switch $S_2$.

Furthermore, when the reset switch $S_2$ is turned ON under the condition of normal hand operation, a signal from the switch compensation circuit 38 is fed to a 30-second division circuit 52 through the signal separator 42. If count time by the 60-number system counter 20 is 0 to +30 seconds, the counter 20 is reset to "0" by the 30-second division circuit 52, while if it is +30 to +59 seconds, the counter 20 is reset to "0" after application of a pulse for driving the pulse motor by one step.

In this manner, time lead or delay within 30 seconds may be corrected by operation of the reset switch $S_2$.

Heretofore, the electronic circuit E in the timepiece of this invention has been explained in detail with reference to FIG. 3.

Figure 4:
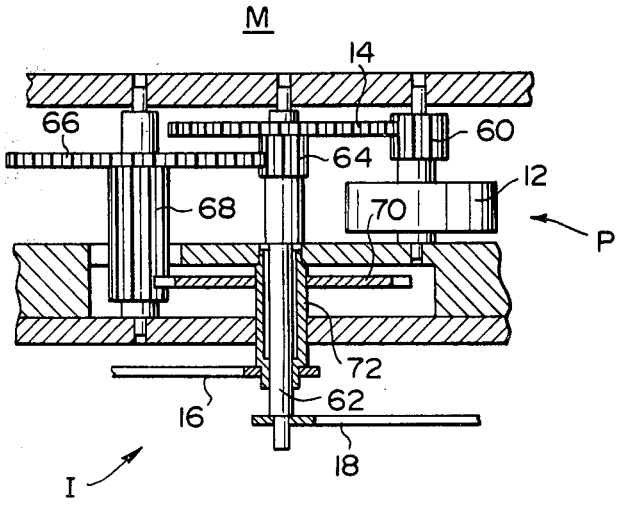
FIG. 4 is a cross-sectional view in part of a hand-indication type electronic timepiece, showing a practical form of movement used therein.

Referring now to FIG. 4, the movement M to which output pulses are delivered from the electronic circuit E will be explained for its practical construction.

As will be clear from FIG. 1, the movement M includes the pulse motor P and the indicating mechanism I. Output pulses from the output 28 as shown in FIG. 3 are applied to the driving coil 10 of the pulse motor P, and the rotor 12 is driven by every one pulse, which is applied to the pulse motor P, an electromechanical transducer. The rotor is represented by numeral 12 in FIG. 4, where numerals 14, 16, and 18 represent the minute wheel, the hour hand, and the minute hand respectively. Rotation of the rotor 12 is transmitted to the minute wheel 14 through a rotor pinion 60. The minute hand 18, which is mounted on the tip of a minute wheel arbor 62, is moved together by every output pulse from the output 28. A minute wheel pinion 64 fixed on the minute wheel 14 engages a third wheel and pinion 66, which has a third wheel pinion 68 mating with an hour wheel 70. The hour wheel 70 rotates around the minute wheel arbor, and the hour hand 16 is mounted on the end of an hour wheel pipe 72. In other words, rotation of the minute wheel 14 is reduced by 1/60 through the third wheel and pinion 66 before it is transmitted to the hour wheel 70.

As has been described supra, the hand-indication type electronic timepiece in accordance with this invention permits time setting by electronic control without using any conventional, complicated mechanism for setting hands, simple construction and reduction in size, and easy manufacture just by adding a plurality of pulse control circuits to existing MOS-LSI devices.

Secondly, here will be explained a pulse motor used in a hand-indication type electronic timepiece of the invention in detail.

Figure 5A:
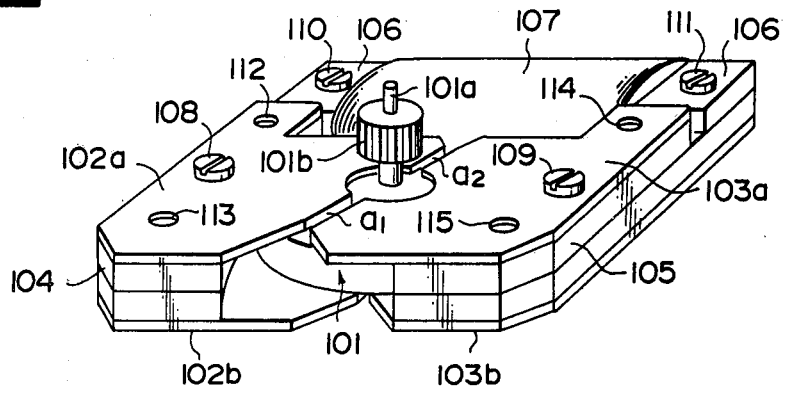
FIG. 5A is a pictorial view of a prior-art pulse motor.
Figure 5B:
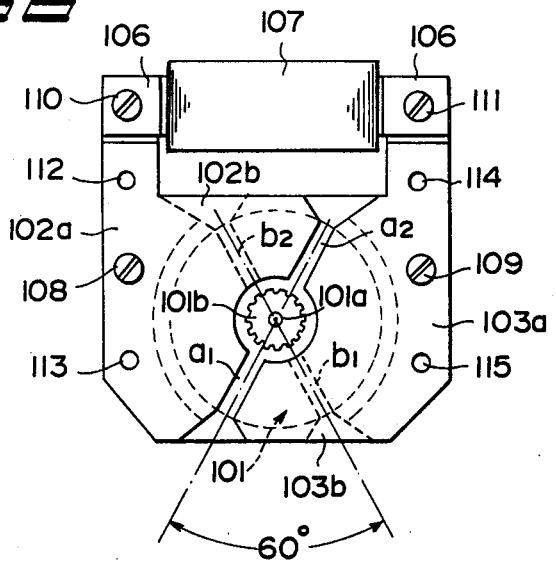
FIG. 5B is a plan view of this pulse motor.
Figure 6:
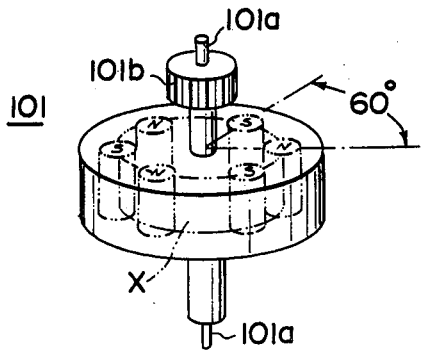
FIG. 6 is a pictorial view of a rotor used in the pulse motor of FIGS. 5A and 5B.

Prior-art pulse motors of this type are constructed, for example, as shown in FIGS. 5A and 5B. FIG. 5A is a pictorial view of such a pulse motor, and FIG. 5B is a plan view of the pulse motor of FIG. 5A. In FIGS. 5A and 5B a reference numeral 101 represents a rotor. The rotor 101 rotates around a shaft 101*a*, and is shaped as shown in FIG. 6, with six magnetic axes formed in parallel with the shaft 101*a* perpetually by magnetization. These magnetic axes are produced along a phantom cylinder X having the shaft 101*a* as a center, and are positioned at angular intervals of 60° with circumferentially alternate magnetic poles NSNS . . . . Thus, on the upper and lower side faces of the rotor 101 appear such alternate magnetic poles at every 60° in a circle or with a phase difference of 60°. A rotor pinion 101*b* is mounted on the shaft 101*a* of the rotor 101 for transmission of its rotation.

A pair of upper stators 102*a* and 103*a* in a plate are provided over the rotor 101 at right angles to the shaft 101*a*. The upper stators 102*a* and 103*a* have two upper opposed portions $a_1$ and $a_2$, which are disposed symmetrically to the shaft 101*a* so as to face magnetic poles opposite in polarity on the upper face of the rotor 101. A pair of lower stators 102*b* and 103*b* in a plate are provided likewise under the rotor 101 orthogonally to the shaft 101*a*. The lower stators 102*b* and 103*b* have two lower opposed portions $b_1$ and $b_2$, which are disposed symmetrically with respect to the shaft 101*a* so as to face magnetic poles opposite in polarity on the lower face of the rotor 101. The upper opposed portion $a_1$ is displaced by an angle of 60° from the lower opposed portion $b_1$, while the upper opposed portion $a_2$ is displaced by the same angle of 60° from the lower opposed portion $b_2$.

A spacer 104 is sandwitched between the upper and lower stators 102*a* and 102*b*, while a spacer 105 is held between the upper and lower stators 103*a* and 103*b*. The spacers 104 and 105 are composed of several magnetic sheets respectively and are used to define a space between the upper and lower stators and couple them magnetically. The spacers 104 and 105 are not made of a signle member but of several sheets of magnetic material in lamination for reducing eddy-current lose to be caused by driving pulses.

The upper stators 102*a*, the spacer 104, and the lower stator 102*b* thus combined into a set are joined to one side of a yoke 106, while the upper stator 103*a*, the spacer 105, and the lower stator 103*b* are joined as a set to the other side of the yoke 106. The driving coil 107 is mounted around the yoke 106 so that the coil 107 can be coupled magnetically to the upper and lower stators 102*a*, 102*b*, and 103*a*, 103*b* respectively. Consequently the upper stator 102*a*, the spacer 104, and the lower stator 102*b* are magnetized with one polarity. The upper stator 103*a*, the spacer 105, and the lower stator 103*b* are magnetized with other polarity.

In FIGS. 5A and 5B, reference numerals 108 and 109 represent machine screws for combining the upper and lower stators with the spacer into a single body; and 110 and 111 represent screws for combining the yoke 106 with the spacer and the lower stator fixedly. Numerals 112 to 115 represent holes for receiving reference pins for positioning use. Such reference pins are provided on any device where the pulse motor is fixed.

When the upper opposed portions $a_1$ and $a_2$ of the upper stators 102*a* and 103*a* are faced to different magnetic poles on the upper face of the rotor 101 respectively, the lower opposed portions $b_1$ and $b_2$ of the stators 102*b* and 103*b* are faced likewise to different magnetic poles on the lower face of the rotor 101 respectively. As already described, a phase difference of 60° is given between the upper and lower opposed portions $a_1$, $a_2$ and $b_1$, $b_2$, and as a result, the upper opposed portion $a_1$ and the lower opposed portion $b_1$ are faced to identical magnetic poles. The upper and lower opposed portions $a_2$ and $b_2$ are faced likewise to other magnetic poles. Thus, when AC pulses are applied to the driving coil 107, the upper and lower stators 102*a* and 102*b* are mannetized alternately with N or S polarity, while the upper and lower stators 103*a* and 103*b* are magnetized alternately with S or N polarity. At the four opposed portions $a_1$, $a_2$, $b_1$, and $b_2$ of the upper and lower stators magnetic attraction and repulsion will occur between the rotor 101 and these portions so as to run the rotor 101 in either direction. In this way the rotor 101 can be driven stepwise by one magnetic pole with every one pulse.

Conventional pulse motors of the above construction and operation require separate fixture of two sets of spacers, and upper and lower stators holding such spacers therebetween.

For fixing such a single set properly, two holes must be made for positioning the single set, and in addition, two reference pins must be provided, generally as many as the holes, on any device or product where a pulse motor is fixed. However, difficulty in design will be increased with an increasing number of reference pins, for example, in wrist watches and the like where a pulse motor must be incorporated in a limited space. The pulse motor shown in FIGS. 5A and 5B requires four reference pins, which have been considerably difficult to arrange.

Furthermore, as described above, each spacer must be formed of a plurality of sheets of magnetic material. This may result in a slight difference in thickness of individual spacer sheets and in great difficulty in setting pairs of opposed portions of stators properly in position. Thus, non-adjustment cannot be possible for conventional pulse motors.

Still furthermore, as shown in FIGS. 5A and 5B, spacers must be made of magnetic material in prior pulse motors. This means another disadvantage of hard workability.

Figure 7:
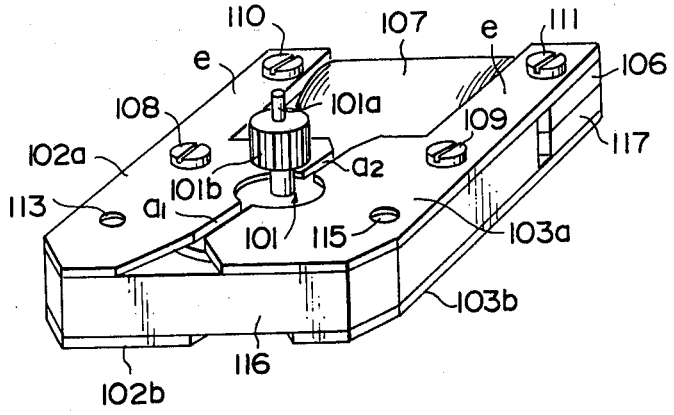
FIG. 7 is a pictorial view of a pulse motor used in a hand-indication type electronic timepiece of the invention, by way of example.

Referring first to FIG. 7, showing one embodiment of the invention, a pulse motor will be explained in detail. The pulse motor shown in FIG. 7 has a spacer 116 instead of spacers 104 and 105 of a pulse motor shown in FIGS. 5A and 5B, and extensions e of individual stators. The spacer 116 made of nonmagnetic material instead of magnetic material is a single member, not separated into two sections such as spacers 104 and 105 in FIGS. 5A and 5B. The extensions e are portions of individual stators extending to be coupled magnetically to a driving coil 107 without through the spacer 116. The upper and lower extensions hold a yoke 106 therebetween at two sides respectively with magnetic spacers 117 put under the yoke 106. These parts are fixed with screws 110 and 111 passing therethrough. The screws 110 and 111 together with screws 108 and 109 are used for mounting the pulse motor.

Thus, in the pulse motor shown in FIG. 7 the single spacer 116 and the upper and lower stators 102*a*, 102*b* and 103*a*, 103*b* holding the spacer therebetween can be fixed integrally as a unit. All that is required for positioning the unit is two holes 113 and 115. Therefore, the number of reference pins can be reduced, compared with conventional pulse motors as shown in FIGS. 5A and 5B.

Furthermore, in the pulse motor of FIG. 7, the spacer 116 is formed of nonmagnetic material and integrally. This makes it easy to fabricate the spacer 116 of even thickness, and consequently the opposed portions $a_1$, $a_2$ and $b_1$, $b_2$ can be mounted properly in position. The pulse motor thus produced requires no adjustment.

However, the pulse motor of FIG. 7 has a problem of difficult removal of the driving coil 107. In other words, the pulse motor shown in FIG. 7 has stator extensions to be coupled magnetically to the driving coil 107. For such coupling the yoke 106 must be held between the upper and lower extensions, as already explained. With such arrangement the screws 108, 109, 110, and 111 must be all removed for taking off the upper stators 102*a* and 103*a*, when the driving coil 107 is removed. This is a drawback.

Figure 8:
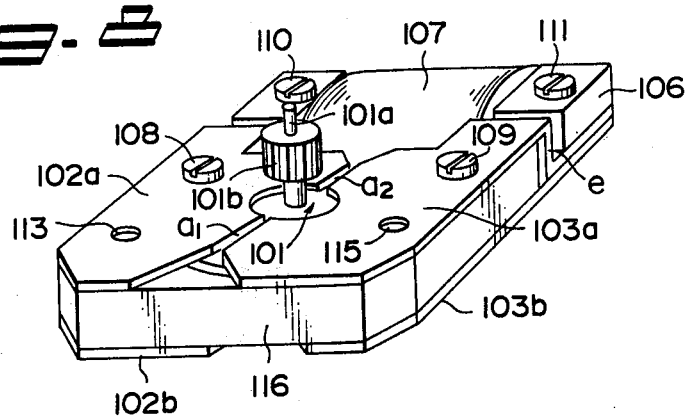
FIG. 8 is a pictorial view of a pulse motor, which is an improvement on the pulse motor of FIG. 7, showing another form of pulse motor for the invention.

A pulse motor shown in FIG. 8 overcomes this drawback by superposing a bent portion of the upper stator on the associated lower stator. In other words, in the pulse motor of FIG. 8, the extensions e of the upper stators 102*a* and 103*a* are bent like a crank so as to be put on the extensions e of the lower stators 102*b* and 103*b* respectively. The yoke 106 is mounted at both ends on the extensions e thus superposed and is then fixed with the screws 110 and 111.

In the pulse motor of FIG. 8, the driving coil 107 can be taken off just by removing the screws 110 and 111 without removing the upper stators 102*a* and 103*a*. Removal of the driving coil 107 is thus made considerably easy. In this manner a pulse motor can be produced which is easy to be built in, easy to remove a driving coil, and unnecessary to adjust.

In the embodiment of FIG. 8, the extensions e of the upper stators 102*a* and 103*a* are bent like a crank and overlaid on the lower stators 102*b* and 103*b*, and the yoke 106 is mounted thereon. Alternatively the extensions e of the upper stators 102*a* and 103*a* may be arranged to push against side faces of the yoke 106 respectively without superposing the upper stators 102*a* and 103*a* on the lower stators 102*b* and 103*b*. In this case the driving coil 107 may also be removed easily. The pulse motor of the invention is not limited to the embodiment shown in FIG. 8 in any sense, where a portion of the upper stator is bent for easy removal of a driving coil and is coupled magnetically to the driving coil.

Conventional pulse motors of this type which are built in wrist watches have stators which are rather thin or as thick as about 0.2 mm. Such stators are so arranged as to be fixed on the both sides of spacers with screws. As a result of tightening the screws, the stators are warped upward, particularly at the edge of opposed portions of the stators, which is far from the screws. This necessitates fine adjustment of such stators.

This disadvantange may be eliminated by fastening the stators uniformly with several pieces of screws. From the viewpoint of design it is rather difficult to add one more screw to any device having a high density of components such as wrist watches.

Figure 9:
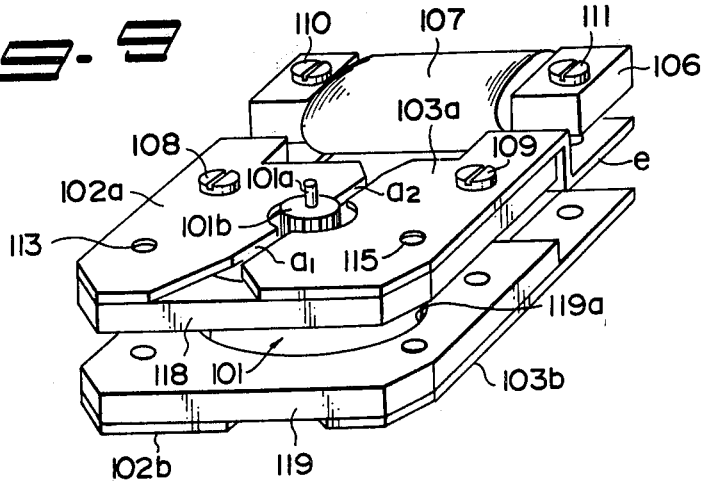
FIG. 9 is a pictorial view of a pulse motor in its assemblying process, which is an improvement on the pulse motor of FIG. 8, showing still another form of pulse motor which may be employed in the timepiece of the invention.

A pulse motor shown in FIG. 9 overcomes this difficulty by dividing a spacer into two parts, one part being attached to the upper stators and one part to the lower stators.

This pulse motor has two upper and lower spacers 118 and 119 formed by dividing the spacer 116 thereinto of the pulse motor shown in FIG. 8. The upper stators 102*a* and 103*a* are attached to the upper side of the upper spacer 118, and the lower stators 102*b* and 103*b* to the lower side of the lower spacer 119. This is done by spot welding or bonding with adhesive.

This pulse motor is constructed by first putting the lower spacer 119 having the lower stators 102*b* and 103*b* attached thereto in position, then setting the rotor 101 in a central opening 119*a* on the spacer 119, mounting the upper spacer 118 having the upper stators 102*a* and 103*a* fixed thereto on the lower spacer 119, and finally fixing them with the screws 108 and 109 as in the pulse motor of FIG. 8.

The pulse motor shown in FIG. 9 has such thick spacers to which thin stators are attached. This prevents the thin stators from being warped as a result of tightening the screws 108 and 109.

As has been described heretofore, a pulse motor can be produced in accordance with the invention, which requires no means for fine adjustment thanks to easy proper setting of opposed portions of individual stators. This pulse motor is highly shock-proof with its spacers serving as reinforcing plates. Furthermore, it has an advantage of easy mounting.

What is claimed is:

1. An hand-indication type electronic timepiece having a quartz crystal vibrator, a frequency divider, an analog time display including hands, a motor for moving the hands and means for generating a series of ordinary hand moving pulses to drive the motor, the timepiece comprising:

a first switch;

means for generating a hand sending pulse at each time when the first switch is operated;

means for generating a quick hand sending pulse while the first switch is closed in response to the closure of the first switch over a determined time interval;

a second switch;

means for stopping the supply of the ordinary hand moving pulses to the motor, the stopping means operating in response to the turning OFF of the first switch after the quick hand sending pulse is generated;

means for memorizing the number n of the ONs of the second switch while the stopping means is in operation; and means for releasing the stop condition of the stopping means when n ordinary hand moving pulses are generated after the stopping means operates.

* * * * *